US005244770A

United States Patent [19]

DeBoer et al.

[11] Patent Number: 5,244,770

[45] Date of Patent: Sep. 14, 1993

[54] DONOR ELEMENT FOR LASER COLOR TRANSFER

[75] Inventors: Charles D. DeBoer, Rochester; Robert G. Spahn, Webster, both of N.Y.

[73] Assignee: Eastman Kodak Company, Rochester, N.Y.

[21] Appl. No.: 781,627

[22] Filed: Oct. 23, 1991

[51] Int. Cl.[5] ..... G03C 7/00; B41N 5/035

[52] U.S. Cl. ..... 430/200; 430/201; 346/76 L; 503/227

[58] Field of Search ..... 346/76 L, 135.1; 430/200, 201, 275; 503/227; 428/195, 209, 210; 359/580

[56] References Cited

U.S. PATENT DOCUMENTS

| | | | |
|---|---|---|---|
| 2,519,722 | 9/1946 | Turner et al. | 359/585 |
| 3,630,732 | 12/1971 | Delzenne et al. | 430/200 |
| 4,335,198 | 6/1982 | Hanada et al. | 346/135.1 |
| 4,388,400 | 6/1983 | Tabei et al. | 430/495 |
| 4,599,298 | 7/1986 | Fisch | 430/201 |
| 4,651,172 | 3/1988 | Watanabe et al. | 430/495 |
| 4,804,975 | 2/1989 | Yip | 346/76 L |
| 4,804,977 | 2/1989 | Long | 346/76 L |
| 4,948,778 | 8/1990 | DeBoer | 430/201 |
| 4,950,640 | 8/1990 | Evans et al. | 503/227 |
| 5,023,229 | 6/1991 | Evans et al. | 430/201 |
| 5,034,303 | 7/1991 | Evans et al. | 430/200 |
| 5,075,146 | 12/1991 | Satake et al. | 346/76 L |

FOREIGN PATENT DOCUMENTS

| | | | |
|---|---|---|---|
| 113018 | 7/1984 | European Pat. Off. . | |
| 58-55292 | 4/1983 | Japan | 346/76 L |
| 59-95195 | 6/1984 | Japan | 346/135.1 |
| 61-31288 | 2/1986 | Japan | 346/76 L |
| 62-54851 | 3/1987 | Japan . | |
| 1-090793 | 4/1989 | Japan . | |

*Primary Examiner*—Charles L. Bowers, Jr.
*Assistant Examiner*—Martin Angebranndt
*Attorney, Agent, or Firm*—Robert L. Randall

[57] ABSTRACT

A donor element for laser color transfer processes includes a heat absorbing layer including a combination of a metal layer with an antireflecting layer having an index of refraction greater than 2. The heat absorbing layer may include a metal or an alloy either in single or multiple layers having a thickness sufficient to yield a heat capacity of less than 0.2 calories per degree Centigrade per square meter and an optical density at the laser wavelength of 1.0 or greater.

5 Claims, 2 Drawing Sheets

DONOR ELEMENT FOR LASER COLOR TRANSFER

FIELD OF THE INVENTION

This invention relates to a thermal printing technique, and more particularly, to a thermal printing technique wherein a combination of a metal layer with an antireflection layer is employed as a heat absorbing means.

BACKGROUND OF THE INVENTION

A thermal printhead typically comprises a row of closely spaced resistive heat generating elements which are selectively energized to record data in text, bar code or pictorial form. In operation, the thermal printhead heating elements selectively receive energy from a power supply through central circuits in response to stored data information. The heat from each energized element may then be applied directly to thermally sensitive material or to a dye coated web to effect transfer of the dye to paper or other designated receiver material.

In one type of thermal printhead which is capable of printing colored images, a donor containing a repeating series of spaced frames of different-colored, heat-transferrable dyes is employed. The donor is disposed between a receiver, such as coated paper, and a printhead formed of a plurality of individual resistive heat generating elements. When a specific resistive element is energized, it produces heat and causes dye from the donor to transfer to the receiver.

These thermal dye transfer printers offer the advantage of a true continuous tone dye density transfer. This result is obtained by varying the energy applied to each heating element, thereby yielding a variable dye density image pixel in the receiver. An effective means for attaining this end involves the use of a laser as the thermal source to heat a donor containing the material to be transferred to a receiver.

Heretofore, it has been common practice to employ a donor including a heat absorbing layer, a base layer and a dye layer which includes a binder and a dye. The heat absorbing layer employed for this purpose contains light absorbing materials such as carbon black or an infrared dye. Unfortunately, such prior art techniques have not proven to be completely satisfactory. More specifically, studies have revealed that the use of carbon black as the light absorbing material limits the ability to heat uniformly and often results in small particle transfer and color contamination. Similar difficulties with respect to color contamination have been encountered with infrared dyes.

SUMMARY OF THE INVENTION

In accordance with the present invention these prior art limitations have been effectively obviated by using a heat absorbing layer comprising a metal layer which is inert and of high melting point. The layer employed cannot be vaporized by the energy of the laser and, consequently, does not result in contamination of the color dyes as they are transferred to a receiver.

In one aspect of the present invention, a donor is employed which includes a heat absorbing layer comprising a combination of a thin metal layer with an antireflection layer selected from among silicon, germanium, zinc sulfide, and metal oxides and nitrides having an index of refraction greater than 2 and, preferably, greater than 2.3.

In accordance with another aspect of the invention, the heat absorbing layer of the donor may comprise a mixture of metals or an alloy either in single or multiple layers provided that the thickness thereof is sufficient to yield a heat capacity of less than 0.2 calories per degree Centigrade per square meter and an optical density at the laser wavelength of 1.0 or greater.

According to yet another aspect of the invention, the antireflection layer is deposited in a thickness equal to an effective quarter wave optical thickness, commonly referred to as QWOT, that is, such a thickness that the phase shift of light passing through the layer and reflecting off the metal/antireflecting layer coating interface, and passing back through the layer, is 180 degrees relative to light simply reflecting off the front surface of the antireflecting layer. This QWOT condition insures that the amount of reflected light will be minimized, thereby maximizing the amount of absorbed light. The antireflection layer material is selected in accordance with the following equation:

$$R_{min}=[(r_1-r_2)^2]/[(1-r_1r_2)^2]<0.4 \qquad \text{(Equation 1)}$$

wherein $R_{min}$ is the reflectance of the laser wavelength for normally incident laser light when the antireflecting layer thickness is an effective QWOT, and wherein, $$r_1=(n_1-n_0)/(n_1+n_0),$$

$n_1$ = the index of refraction of the antireflection layer, and $n_0$ = the index of refraction of the medium adjacent to the antireflecting layer, and $$r_2=\{[(n_m-n_1)^2+Km^2]/[(n_m+n_1)^2+Km^2]\}^{\frac{1}{2}} \qquad \text{(Equation 2)}$$

wherein, $n_m$ = the index of refraction of the metal layer, and

Km = the absorption coefficient of the metal layer.

Viewed from one aspect, the present invention is directed to a donor element for color transfer. The donor element comprises a base layer, a dye layer comprising a binder and a dye, and a heat absorbing layer. The dye may be chosen from among the sublimable dyes described in U.S. Pat. No. 5,034,303 (issued to S. Evans and C. DeBoer on Jul. 23, 1991). The heat absorbing layer comprises a metallic element of the Periodic Table of the Elements either alone, in combination with another metallic element or alloyed with another metallic element, and an antireflecting layer that can be any transparent material satisfying Equation 1, above. Preferred materials for this purpose may be selected from among silicon, germanium, zinc sulfide, titanium dioxide and tantalum pentoxide.

Viewed from another aspect, the present invention is directed to a thermal printing system having a donor element for color transfer comprising a base layer, a dye layer comprising a binder and a dye, and a heat absorbing layer comprising a metallic element of the Periodic Table of the Elements either alone, in combination with another metallic element or alloyed with another metallic element, and an antireflecting layer that can be any transparent material satisfying Equation 1, above.

The invention will be more readily understood by reference to the following detailed description taken in conjunction with the accompanying drawing and claims.

DETAILED DESCRIPTION

Figure 1:
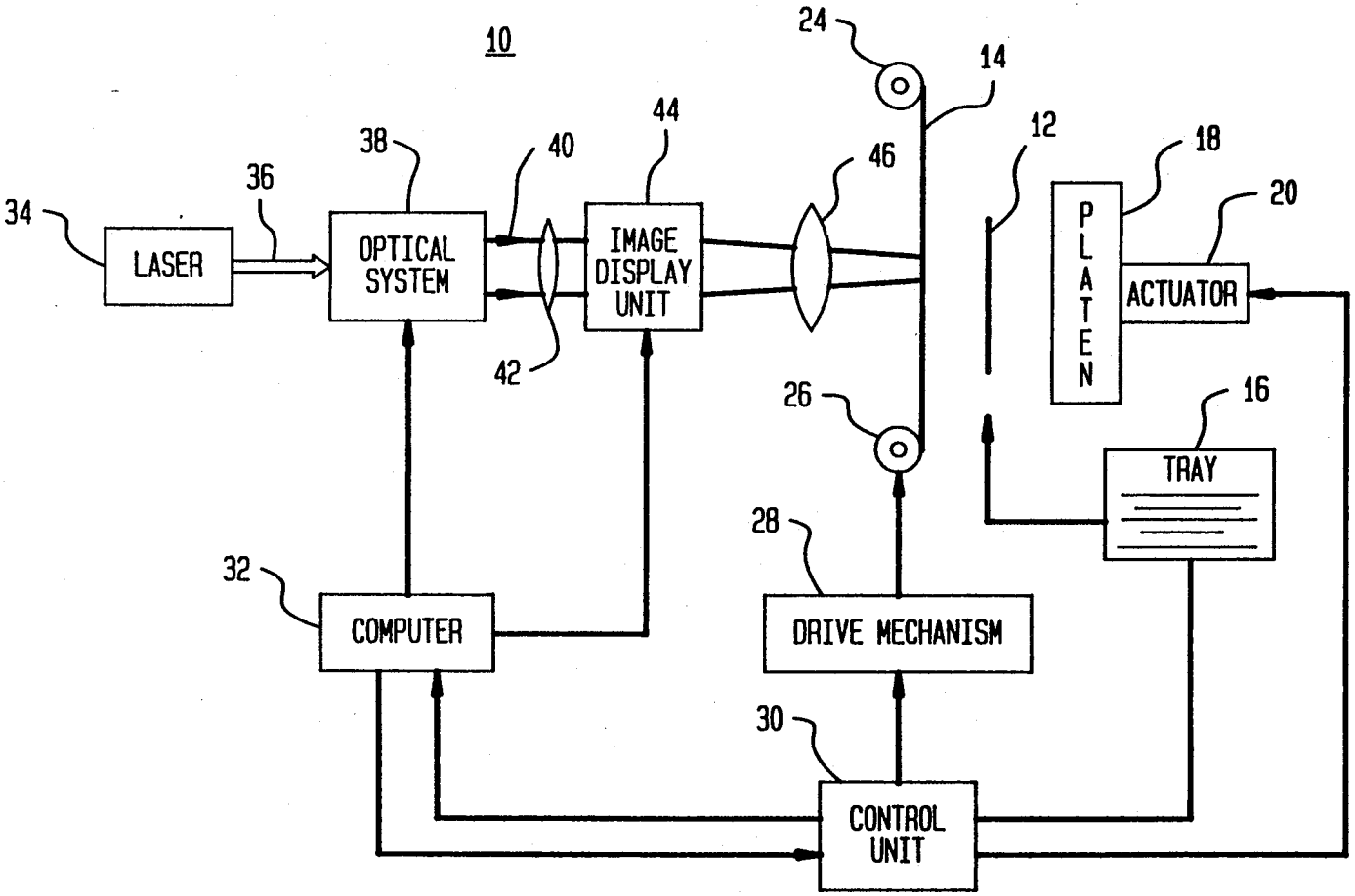
FIG. 1 is a schematic representation of a thermal printing apparatus which generates a dye image in a receiver using a donor in accordance with the invention.
Figure 2:
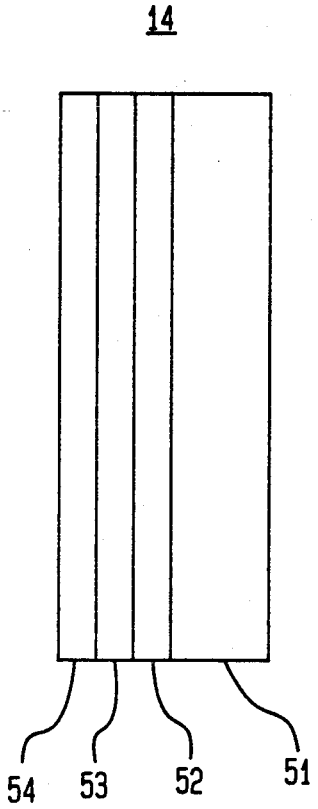
FIG. 2 is an enlarged cross sectional view of the donor of FIG. 1.

Referring now to FIG. 1, there is shown thermal printer apparatus 10 in accordance with the present invention. The thermal printer apparatus 10 comprises receiver members 12, a dye donor member (element) 14, a tray 16, a platen 18, an actuator 20, a supply roller 24, a take-up roller 26, a drive mechanism 28, a control unit 30, a computer 32, a laser 34, an optical system 38, a lens 42, an image display unit 44, and a lens 46. An enlarged and detailed cross-sectional view of the donor member 14 is shown in FIG. 2. The receiver members 12, in the form of a sheet, are serially fed from a tray 16 to a print position by a conventional sheet feeding mechanism (not shown). An actuator 20 coupled to a platen 18 moves the platen 18 into print position which causes the receiver members 12 to be pressed against the dye donor member 14. The donor member 14, which comprises a heat absorbing layer in accordance with the present invention, is driven along a path from a supply roller 24 onto a take-up roller 26 by a drive mechanism 28 coupled to take-up roller 26.

A control unit 30 comprising a minicomputer converts digital signals from a computer 32 to analog signals and sends them as appropriate control signals to the sheet feeding mechanism, actuator 20 and drive mechanism 28.

The receiving members 12 comprise a receiving layer and a substrate. The receiving layer absorbs dye and retains the image dyes to yield a bright hue. The substrate provides support for the receiver members (sheet) 12. In practice, the receiving layer may comprise polycarbonate. Paper or films such as polyethylene terephthalate may also be used as the substrate.

The donor member 14 is pressed against the receiver members (sheet) 12 by the actuator 20. Heat generated by incoming light from a laser vaporizes the dye in the donor and the dye is dispersed into the receiver members 12.

As shown in FIG. 1, the laser 34 emits radiation (a laser beam) 36 in a spectral region absorbable by the donor element 14. The laser beam 36 is accepted by the optical system 38 which expands and controls the laser beam 36 while maintaining its collimated character. Optical system 38 expands laser beam 36 to a beam 40 which passes through the lens 42, the image display unit 44 and is then focused by the lens 46 onto the donor member 14. Outputs of computer 32 are coupled to inputs of the optical system 38 and the image display unit 44.

Referring now to FIG. 2, there is shown an enlarged and detailed cross-sectional view of the donor member 14 of FIG. 1. The donor 14 comprises a substrate member (base layer) 51 having deposited thereon successively an antireflecting layer 52, a heat absorbing metal layer 53, and a dye layer 54 comprising a dye of the type noted and, optionally, a binder.

The binder employed can be selected from among any polymeric material which provides adequate physical properties and permits dye to sublime out of the layer. Certain organic cellulosic materials such as cellulose nitrate, ethyl cellulose, cellulose triacetate and cellulosic mixed esters such as cellulose acetate propionate may be used for this purpose.

The donor member 14, as noted, comprises a substrate member 51 having three layers deposited thereon, an antireflecting layer 52, a heat absorbing metal layer 53 and a dye layer 54. The heat absorbing metal layer 53 comprises any of the metallic elements of the Periodic Table of the Elements either alone or in alloyed combination or layer combination. The thickness of the metal layer 53 is chosen such that it evidences a heat capacity less than 0.2 calories per degree Centigrade per square meter and an optical density at the laser wavelength of 1.0 or greater. Metals found to be particularly useful for this purpose include tantalum, lead, platinum, niobium, nickel, cadmium, cobalt, bismuth, antimony, chromium, palladium, rhodium, titanium, iron, molybdenum, zinc, tungsten, manganese and tin. A general preference has been found to exist for titanium, nickel and tin.

The antireflection layer 52 chosen for use herein is any transparent material satisfying Equation 1, above. Preferred materials are selected from among silicon, germanium, zinc sulfide, titanium dioxide and tantalum pentoxide. A general preference exists for silicon and titanium dioxide. The index of refraction of the antireflecting layer is preferably greater than 2 and preferably greater than 2.3. The antireflection layer 52 is deposited in a thickness equal to an effective quarter wave optical thickness, commonly referred to as QWOT, that is, such a thickness that the phase shift of light passing through the layer and reflecting off the metal/antireflecting layer coating interface, and passing back through the layer, is 180 degrees relative to light simply reflecting off the front surface of the antireflecting layer. This QWOT condition insures that the amount of reflected light will be minimized, thereby maximizing the amount of absorbed light. The antireflection layer material is selected in accordance with the following equation:

$$R_{min}=[(r_1-r_2)^2]/[(1-r_1r_2)^2]<0.4$$

wherein $$r_1=(n_1-n_0)/(n_1+n_0),$$

$n_1$ = the index of refraction of the antireflection layer 52, and $n_0$ = the index refraction of the medium 51 (the base in this case) adjacent to the antireflecting layer 52, and $$r_2=\{[(n_m-n_1)+Km^2]/[(n_m+n_1)^2+Km^2]\}^{\frac{1}{2}}$$

wherein, $n_m$ = the index of reflection of the metal layer, and

Km = the absorption coefficient of the metal layer.

The heat absorbing metal layer 53 of the invention is prepared by first depositing an antireflecting layer by conventional vacuum deposition techniques in the required thickness upon a suitable inert substrate such as polyethylene terephthalate. Following, a metal of the type previously described is deposited by any suitable vacuum deposition technique upon the antireflecting layer in the required thickness. Then, any of the conventional sublimable dyes of the type described in U.S. Pat. No. 4,804,977 (M. E. Long, issued on Feb. 14, 1989) is deposited upon the metal layer.

Examples of a donor member 14 in accordance with the present invention are set forth below. These examples are intended to be solely for purposes of exposition and are not to be construed as limiting.

EXAMPLE 1

A 100 micron thick film of polyethylene terephthalate was coated by conventional vacuum evaporation techniques with an approximately 723 Angstrom thick layer of titanium dioxide. Then, an approximately 448 Angstrom thick layer of titanium was deposited upon the titanium dioxide layer by vacuum evaporation to yield a layer having an optical density of approximately 0.75 and a reflectivity less than 15 percent at the laser wavelength. Following, a dye mixture comprising 100 milligrams of magenta dye and 200 milligrams of cellulose acetate propionate dissolved in 3.0 milliliters of cyclohexanone and 3.0 milliliters of acetone was deposited upon the titanium layer by swabbing the dye binder mixture thereon with a cotton swab. The dye binder overcoat was then dried and the resultant structure placed in a system of the type depicted in FIG. 1 as the donor member 14. The donor member was then exposed to an 86 milliwatt diode laser beam at 830 nanometers focused down to a 30 micron spot diameter with an exposure time of approximately 100 microseconds. The magenta dye was absorbed in the receiving member 12 of the system 10 of FIG 1. The transferred magenta dye density was 0.86 as measured by reflection with a Status A green filter on an X-rite densitometer. A control coating of the dye mixture coated on plain polyethylene terephthalate, without the metal/metal oxide layer gave no measurable density upon exposure to the laser light.

EXAMPLE 2

A 100 micron thick film of polyethylene terephthalate was coated with approximately 460 Angstroms of silicon by vacuum evaporation techniques. Following, an approximately 450 Angstrom thick layer of nickel was vacuum evaporated upon the silicon to yield an optical density ranging between 1 and 2. Next, a solution comprising 0.5869% magenta dye, 0.538% cellulose acetate propionate and 0.0245% of a commercially available surfactant all dissolved in dichloromethane was deposited upon the nickel layer. After the dye dried, the resultant structure was placed as a donor member 14 in a system 10 of the type described in FIG. 1. The donor member 14 was then exposed to a 37 milliwatt diode laser beam at 830 nanometers focused down to a spot 8 microns in diameter for approximately 10 microseconds. The transferred magenta dye evidenced a resulting density of 1.07 as measured by reflection with a Status A green filter. A control coating of nickel alone, without the antireflecting layer of silicon, evidenced a transferred magenta dye density less than 0.05. Another control coating of the dye layer alone on polyethylene terephthate without nickel or silicon gave no measurable transferred magenta density.

The color purity of the transferred dye was also measured in this example. A control coating was prepared with a dye binder mixture of the type described above but with the addition of an infrared dye. The control coating was exposed to the laser beam in the same manner as the metal sample and both the red/green and blue/green optical density ratios of the transferred magenta dye were measured to determine the color purity of the transferred dye. A red/green ratio of 0.21 was found for the silicon-nickel coating and 0.37 for the infrared dye coating but with substantially less unwanted color in the silicon-nickel case. The blue/green ratio was 0.178 for the silicon-nickel coating and 0.261 for the infrared dye. Once again, there was substantially less unwanted color in the silicon-nickel case.

While the invention has been described in detail in the foregoing specification and exemplary embodiments, it will be understood that variations may be made without departing from the spirit and scope of the invention. For example, the metal, heat-absorbing layer and the antireflecting layer may be deposited by cathodic sputtering techniques or by pyrolytic heating. Similarly, the dye selected for use in the dye layer may comprise any of the sublimable anthraquinone dyes, acid dyes or basic dyes.

What is claimed is:

1. A donor element for color transfer comprising successively:

a base layer;

an antireflecting layer formed of a material having a thickness equal to an effective quarter wave optical thickness which layer is selected in accordance with the equation:

$$R_{min}=[(r_1-r_2)^2]/[(1-r_1r_2)^2]<0.4$$

wherein $R_{min}$ is the reflectance of the laser wavelength for normal incident laser light when the antireflecting layer thickness is an effective QWOT, and wherein $$r_1=(n_1-n_0)/(n_1+n_o)$$

$n_1$ = the index of refraction of the antireflecting layer, $n_0$ = the index of refraction of the medium adjacent to the antireflecting layer, and $$r_2=\{[(n_m-n_1)^2+Km^2]/(n_m+n_1)^2+Km^2]\}^{\frac{1}{2}}$$

wherein $n_m$ = the index of refraction of the metal layer, and

Km = the absorption coefficient of the metal layer;

a heat absorbing layer comprising a metallic element of the Periodic Table of the Elements either alone or in combination with another metallic element or alloyed with another metallic element; and a dye layer comprising a binder and a sublimable dye.

2. The donor element of claim 1 wherein the antireflecting layer is selected from the group consisting of silicon, germanium, zinc sulfide, titanium dioxide and tantalum pentoxide.

3. The donor element of claim 1 wherein the thickness of the metal layer is such that it evidences a heat capacity less than 0.2 calories per degree centigrade per square meter and an optical density at the laser wavelength of 1.0.

4. The donor element of claim 1 wherein the metal layer comprises titanium and the antireflecting layer comprises titanium dioxide.

5. A donor element for color transfer comprising successively:

a base layer;

an antireflecting layer comprising silicon having a thickness equal to an effective quarter wave optical thickness;

a heat absorbing layer comprising nickel; and a dye layer comprising a binder and a sublimable dye.

* * * * *